US011377967B2

(12) United States Patent
Skidelsky et al.

(10) Patent No.: US 11,377,967 B2
(45) Date of Patent: Jul. 5, 2022

(54) PRE-FORMED FACETED TURBINE BLADE DAMPER SEAL

(71) Applicant: United Technologies Corporation, Farmington, CT (US)

(72) Inventors: Vladimir Skidelsky, West Hartford, CT (US); Carlos Calixtro, Atlanta, GA (US); Matthew B. DeGostin, Eastford, CT (US); John E. Paul, Portland, CT (US); Mohamed Hassan, Palm City, FL (US); Charles Thistle, New Haven, CT (US); Jeffrey Michael Jacques, East Hartford, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 37 days.

(21) Appl. No.: 16/705,451

(22) Filed: Dec. 6, 2019

(65) Prior Publication Data

US 2021/0172324 A1 Jun. 10, 2021

(51) Int. Cl.
*F01D 5/22* (2006.01)
*F01D 11/00* (2006.01)
(Continued)

(52) U.S. Cl.
CPC ..... *F01D 5/22* (2013.01); *F01D 11/006* (2013.01); *F01D 5/081* (2013.01); *F01D 5/3007* (2013.01);
(Continued)

(58) Field of Classification Search
CPC ..... F01D 11/005; F01D 11/006; F01D 5/22; F01D 5/081; F01D 5/3007;
(Continued)

(56) References Cited

U.S. PATENT DOCUMENTS 3,853,425 A * 12/1974 Scalzo ..... F01D 5/18 416/95
4,101,245 A 7/1978 Hess et al.
(Continued)

FOREIGN PATENT DOCUMENTS

EP 3091190 A1 11/2016
EP 3342983 A1 7/2018
(Continued)

OTHER PUBLICATIONS

European Search Report for Application No. 20 21 2053; dated Mar. 11, 2021.

*Primary Examiner* — Courtney D Heinle
*Assistant Examiner* — Ryan C Clark
(74) *Attorney, Agent, or Firm* — Cantor Colburn LLP

(57) ABSTRACT

A damper seal for a turbine blade of a gas turbine engine, the damper seal having: an upper portion; a first downwardly curved portion; and a second downwardly curved portion, the first downwardly curved portion and the second downwardly curved portion extend from opposing end regions of the upper portion, the upper portion having a length extending between the opposing end regions of the upper portion and a width transverse to the length, wherein the upper portion is curved along the entire width as it extends along the length.

20 Claims, 12 Drawing Sheets

(51) Int. Cl.
*F01D 5/08* (2006.01)
*F01D 5/30* (2006.01)

(52) U.S. Cl.
CPC .... *F05D 2220/323* (2013.01); *F05D 2230/60* (2013.01); *F05D 2240/55* (2013.01); *F05D 2240/81* (2013.01); *F05D 2260/96* (2013.01)

(58) Field of Classification Search
CPC ..... F05D 2220/323; F05D 2230/60; F05D 2240/55; F05D 2240/81; F05D 2260/96
See application file for complete search history.

(56) References Cited

U.S. PATENT DOCUMENTS

| | | | | |
|---|---|---|---|---|
| 4,183,720 | A | 1/1980 | Brantley | |
| 4,457,668 | A * | 7/1984 | Hallinger | F01D 5/3007 416/95 |
| 5,785,499 | A | 7/1998 | Houston et al. | |
| 8,210,799 | B1 * | 7/2012 | Rawlings | F01D 11/005 415/135 |
| 9,810,075 | B2 * | 11/2017 | Lana | F01D 11/008 |
| 10,012,085 | B2 * | 7/2018 | Hough | F01D 5/3007 |
| 10,030,530 | B2 | 7/2018 | Snyder | |
| 10,100,648 | B2 * | 10/2018 | Niezelski | F01D 5/26 |
| 10,113,434 | B2 * | 10/2018 | Snyder | F01D 11/006 |
| 10,731,479 | B2 * | 8/2020 | Thistle | F01D 5/26 |
| 2016/0251963 | A1 * | 9/2016 | Tardif | F01D 5/22 416/219 R |
| 2016/0326898 | A1 * | 11/2016 | Mongillo, Jr. | F01D 11/006 |
| 2018/0187558 | A1 | 7/2018 | Thistle et al. | |
| 2018/0187562 | A1 * | 7/2018 | Thistle | F01D 5/22 |

FOREIGN PATENT DOCUMENTS

| | | | |
|---|---|---|---|
| EP | 3342985 | A1 | 7/2018 |
| GB | 2226368 | A | 6/1990 |
| WO | 2014159152 | A1 | 10/2014 |

* cited by examiner

PRE-FORMED FACETED TURBINE BLADE DAMPER SEAL

BACKGROUND

This disclosure relates to a gas turbine engine, and more particularly to a pre-formed damper seal that is used in a gas turbine engine.

A gas turbine engine includes a plurality of turbine blades each received in a slot of a turbine disk. The turbine blades are exposed to aerodynamic forces that can result in vibratory stresses. A damper can be located under platforms of adjacent turbine blades to reduce the vibratory response and provide frictional damping between the turbine blades. The damper slides on an underside of the platforms. The damper is made of a material that is dissimilar from the material of the turbine blades. When the vibratory motions of adjacent turbine blades oppose each other (that is, occur out of phase), the damper slides to absorb the energy of vibration. It is usually a stiff slug of metal with rigid features to provide consistent contact with each side of the platform.

Additionally, the turbine blades are exposed to hot gasses. An air cavity between a turbine disk and a gas path of a turbine blade may be pressurized with cooling air to protect the turbine disk from high temperatures. A separate seal is often located near the platform to control the leakage of the cooling air into the hot gasses, improving engine performance and fuel efficiency.

During assembly of the high pressure turbine rotor, a damper or damper seal sits loosely between neighboring blades. In order for the damper to reach design intent and reach maximum effectiveness, it requires a break-in period to conform to the blade under-platform geometry. This is achieved during the initial engine start-up and operation acceptance testing, where under heat and centrifugal loading, the damper begins to deform and take the shape of the blade under-platform geometry which increases the damping effectiveness and seals the mate-face gap.

Accordingly, it is desire to provide a damper or damper seal that reduces the required break in period.

BRIEF DESCRIPTION

Disclosed is a damper seal for a turbine blade of a gas turbine engine, the damper seal having: an upper portion; a first downwardly curved portion; and a second downwardly curved portion, the first downwardly curved portion and the second downwardly curved portion extend from opposing end regions of the upper portion, the upper portion having a length extending between the opposing end regions of the upper portion and a width transverse to the length, wherein the upper portion is curved along the entire width as it extends along the length.

In addition to one or more of the features described above, or as an alternative to any of the foregoing embodiments, the width of the upper portion has a constant radius profile running along the entire width as it extends along the length.

In addition to one or more of the features described above, or as an alternative to any of the foregoing embodiments, the first downwardly curved portion includes a first tab and a second tab each extending in opposing directions with respect to the first downwardly curved portion, and a third tab that extends from the first tab and the second tab of the first downwardly curved portion in the same general direction as the first downwardly curved portion; and the second downwardly curved portion includes a first tab and a second tab each extending in opposing directions with respect to the second downwardly curved portion, and a third tab that extends from the first tab and the second tab of the second downwardly curved portion in the same general direction as the second downwardly curved portion.

In addition to one or more of the features described above, or as an alternative to any of the foregoing embodiments, a height of the second downwardly curved portion relative to the upper portion is longer than a height of the first downwardly curved portion relative to the upper portion.

In addition to one or more of the features described above, or as an alternative to any of the foregoing embodiments, the damper seal is formed from stamped sheet metal.

In addition to one or more of the features described above, or as an alternative to any of the foregoing embodiments, the damper seal further includes a mistake proofing tab extending from the third tab of the first downwardly curved portion and a mistake proofing opening located in the third tab of the second downwardly curved portion.

In addition to one or more of the features described above, or as an alternative to any of the foregoing embodiments, the width of the upper portion has a constant radius profile running along the entire width as it extends along the length.

In addition to one or more of the features described above, or as an alternative to any of the foregoing embodiments, a height of the second downwardly curved portion relative to the upper portion is longer than a height of the first downwardly curved portion relative to the upper portion.

In addition to one or more of the features described above, or as an alternative to any of the foregoing embodiments, the damper seal is formed from stamped sheet metal.

Also disclosed is a turbine disk of a gas turbine engine having a plurality of turbine blades each of the plurality of turbine blades being secured to the turbine disk, at least one of the plurality of turbine blades having: a root; a platform located between the root and an airfoil of the blade, wherein the platforms of adjacent blades of the disk define a cavity; and a damper seal received in the cavity the damper seal having: an upper portion; a first downwardly curved portion; and a second downwardly curved portion, the first downwardly curved portion and the second downwardly curved portion extend from opposing end regions of the upper portion, the upper portion having a length extending between the opposing end regions of the upper portion and a width transverse to the length, wherein the upper portion is curved along the entire width as it extends along the length, the upper portion being position to cover a mate face gap between platforms of adjacent turbine blades of the disk.

In addition to one or more of the features described above, or as an alternative to any of the foregoing embodiments, the width of the upper portion has a constant radius profile running along the entire width as it extends along the length.

In addition to one or more of the features described above, or as an alternative to any of the foregoing embodiments, the first downwardly curved portion includes a first tab and a second tab each extending in opposing directions with respect to the first downwardly curved portion, and a third tab that extends from the first tab and the second tab of the first downwardly curved portion in the same general direction as the first downwardly curved portion; and the second downwardly curved portion includes a first tab and a second tab each extending in opposing directions with respect to the second downwardly curved portion, and a third tab that extends from the first tab and the second tab of the second downwardly curved portion in the same general direction as the second downwardly curved portion.

In addition to one or more of the features described above, or as an alternative to any of the foregoing embodiments, a height of the second downwardly curved portion relative to the upper portion is longer than a height of the first downwardly curved portion relative to the upper portion.

In addition to one or more of the features described above, or as an alternative to any of the foregoing embodiments, the damper seal is formed from stamped sheet metal.

In addition to one or more of the features described above, or as an alternative to any of the foregoing embodiments, the damper seal further comprises a mistake proofing tab extending from the third tab of the first downwardly curved portion and a mistake proofing opening located in the third tab of the second downwardly curved portion.

In addition to one or more of the features described above, or as an alternative to any of the foregoing embodiments, the width of the upper portion has a constant radius profile running along the entire width as it extends along the length.

In addition to one or more of the features described above, or as an alternative to any of the foregoing embodiments, a height of the second downwardly curved portion relative to the upper portion is longer than a height of the first downwardly curved portion relative to the upper portion.

In addition to one or more of the features described above, or as an alternative to any of the foregoing embodiments, the turbine disk is a first stage of a high pressure turbine.

Also disclosed is a method of damping vibrations between adjoining blades of a gas turbine engine, the method including the steps of: locating a damper seal adjacent to a mate face gap defined by adjacent platforms of blades secured to a disk of the gas turbine engine, the damper seal comprising an upper portion; a first downwardly curved portion; and a second downwardly curved portion, the first downwardly curved portion and the second downwardly curved portion extend from opposing end regions of the upper portion, the upper portion having a length extending between the opposing end regions of the upper portion and a width transverse to the length, wherein the upper portion is curved along the entire width as it extends along the length.

In addition to one or more of the features described above, or as an alternative to any of the foregoing embodiments, the width of the upper portion has a constant radius profile running along the entire width as it extends along the length.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the FIGS. Reference is made to U.S. Pat. No. 9,810,075 the contents of which are incorporated herein by reference thereto.

Figure 1:
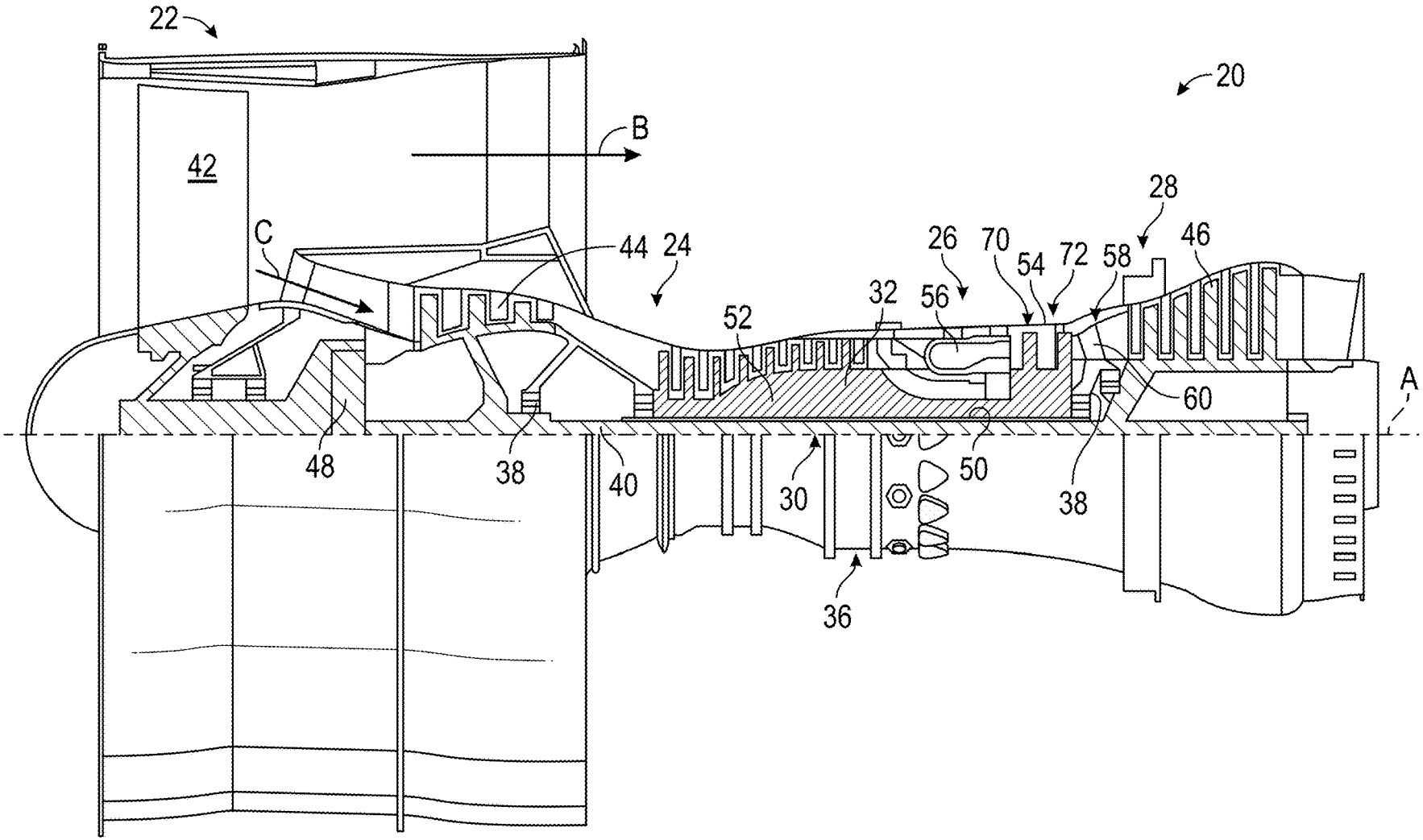
FIG. 1 is a schematic, partial cross-sectional view of a gas turbine engine in accordance with this disclosure.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include other systems or features. The fan section 22 drives air along a bypass flow path B in a bypass duct, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

Although depicted as a turbofan gas turbine engine in the disclosed non-limiting embodiment, it should be understood that the concepts described herein are not limited to use with turbofans as the teachings may be applied to other types of turbine engines or geared turbofan architectures.

The fan section 22 drives air along a bypass flowpath B while the compressor section 24 drives air along a core flowpath C for compression and communication into the combustor section 26 then expansion through the turbine section 28.

The engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that interconnects a fan 42, a low pressure compressor 44 and a low pressure turbine 46. The inner shaft 40 is connected to the fan 42 through a geared architecture 48 to drive the fan 42 at a lower speed than the low speed spool 30. The high speed spool 32 includes an outer shaft 50 that interconnects a high pressure compressor 52 and a high pressure turbine 54.

Figure 2:
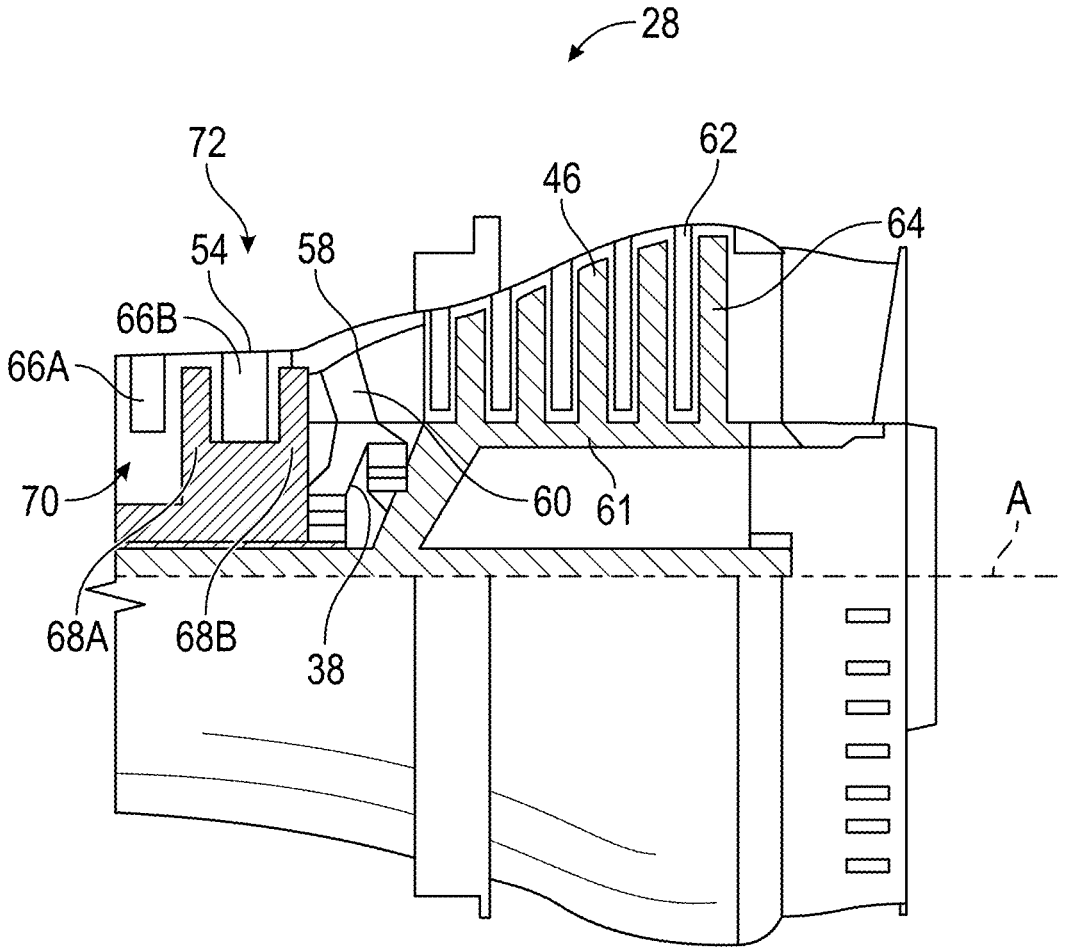
FIG. 2 is a portion of a turbine section of the engine illustrated in FIG. 1.

As shown in FIG. 2, the high pressure turbine 54 includes a first stage 70 and a second stage 72. The first stage 70 includes a static vane 66A and plurality of turbine blades 68A. The second stage 72 includes a static vane 66B and a plurality of turbine blades 68B.

A combustor 56 is arranged between the high pressure compressor 52 and the high pressure turbine 54.

A mid-turbine frame 58 of the engine static structure 36 is arranged generally between the high pressure turbine 54 and the low pressure turbine 46. The mid-turbine frame 58 further supports bearing systems 38 in the turbine section 28.

The inner shaft 40 and the outer shaft 50 are concentric and rotate via bearing systems 38 about the engine central longitudinal axis A, which is collinear with their longitudinal axes.

The core airflow C is compressed by the low pressure compressor 44, then the high pressure compressor 52, mixed and burned with fuel in the combustor 56, then expanded over the high pressure turbine 54 and low pressure turbine 46. The mid-turbine frame 58 includes airfoils 60 which are in the core airflow path. The turbines 46, 54 rotationally drive the respective low speed spool 30 and high speed spool 32 in response to the expansion.

The engine 20 is in one example a high-bypass geared aircraft engine. In a further example, the engine 20 bypass ratio is greater than about six (6:1) with an example embodiment being greater than ten (10:1). The geared architecture 48 is an epicyclic gear train (such as a planetary gear system or other gear system) with a gear reduction ratio of greater than about 2.3 (2.3:1). The low pressure turbine 46 has a pressure ratio that is greater than about five (5:1). The low pressure turbine 46 pressure ratio is pressure measured prior to inlet of low pressure turbine 46 as related to the pressure at the outlet of the low pressure turbine 46 prior to an exhaust nozzle.

In one disclosed embodiment, the engine 20 bypass ratio is greater than about ten (10:1), and the fan diameter is significantly larger than that of the low pressure compressor 44. The low pressure turbine 46 has a pressure ratio that is greater than about five (5:1). The geared architecture 48 may be an epicycle gear train, such as a planetary gear system or other gear system, with a gear reduction ratio of greater than about 2.5 (2.5:1). It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (11,000 meters). The flight condition of 0.8 Mach and 35,000 feet (11,000 meters), with the engine at its best fuel consumption, also known as bucket cruise Thrust Specific Fuel Consumption ("TSFC"). TSFC is the industry standard parameter of lbm of fuel being burned divided by lbf of thrust the engine produces at that minimum point.

"Low fan pressure ratio" is the pressure ratio across the fan blade alone, without a Fan Exit Guide Vane ("FEGV") system. The low fan pressure ratio as disclosed herein according to one non-limiting embodiment is less than about 1.45.

"Low corrected fan tip speed" is the actual fan tip speed in feet per second divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 feet per second (350.5 meters per second).

FIG. 2 illustrates the turbine section 28. The turbine section 28 includes turbine discs 61 that each rotate about the axis A. In the first stage 70 of the high pressure turbine 54, a plurality of turbine blades 68A are mounted on a turbine disk 61. In the second stage 72 of the high pressure turbine 54, a plurality of turbine blades 68B are mounted on another turbine disk 61.

Figure 3:
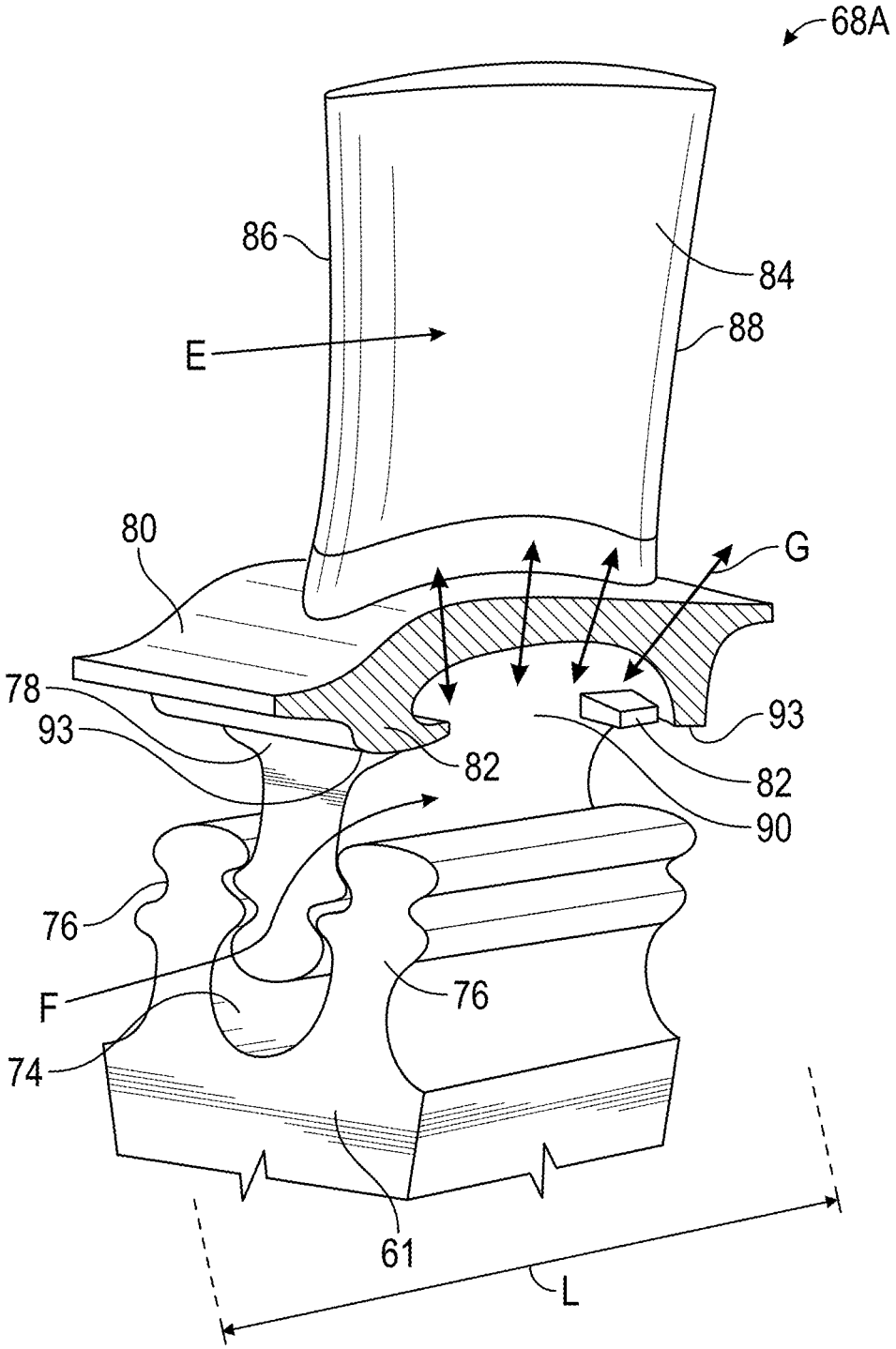
FIG. 3 illustrates a turbine blade secured to a turbine disk.

FIG. 3 illustrates a perspective view of a turbine blade 68A partially installed in a turbine disk 61. In one example, the turbine blades 68A are made of a nickel alloy. The turbine disk 61 includes a plurality of slots 74 separated by turbine disk lugs 76. The slot may be in the shape of a dovetail, a fir tree shape, or some other configuration. The turbine blade 68A includes a root 78 that is received in one of the plurality of turbine disk slots 74 of the turbine disk 61, a platform 80 including retention shelves 82 and buttresses 93, and an airfoil 84. The platform 80 has a length L. The airfoil 84 has a leading edge 86 and a trailing edge 88. A neck cavity 90 is defined between the platform 80 and the retention shelf 82. A buttress 93 is also located in the neck cavity 90 and under the platform 80 of each turbine blade 68A. The buttress 93 is a support structure that connects the platform 80 to the retention shelf 82. Although FIG. 3 illustrates a single turbine blade 68A a plurality of turbine blades are secured to the turbine disk 61. For convenience, only a portion of the turbine disk 61 is illustrated.

Hot gasses flow along a hot gas flow path E. The neck cavity 90 between adjacent turbine blades 68A is pressurized with a flow of cooling air F to protect the turbine discs 61 from the hot gasses in the hot gas flow path E.

Figure 4A:
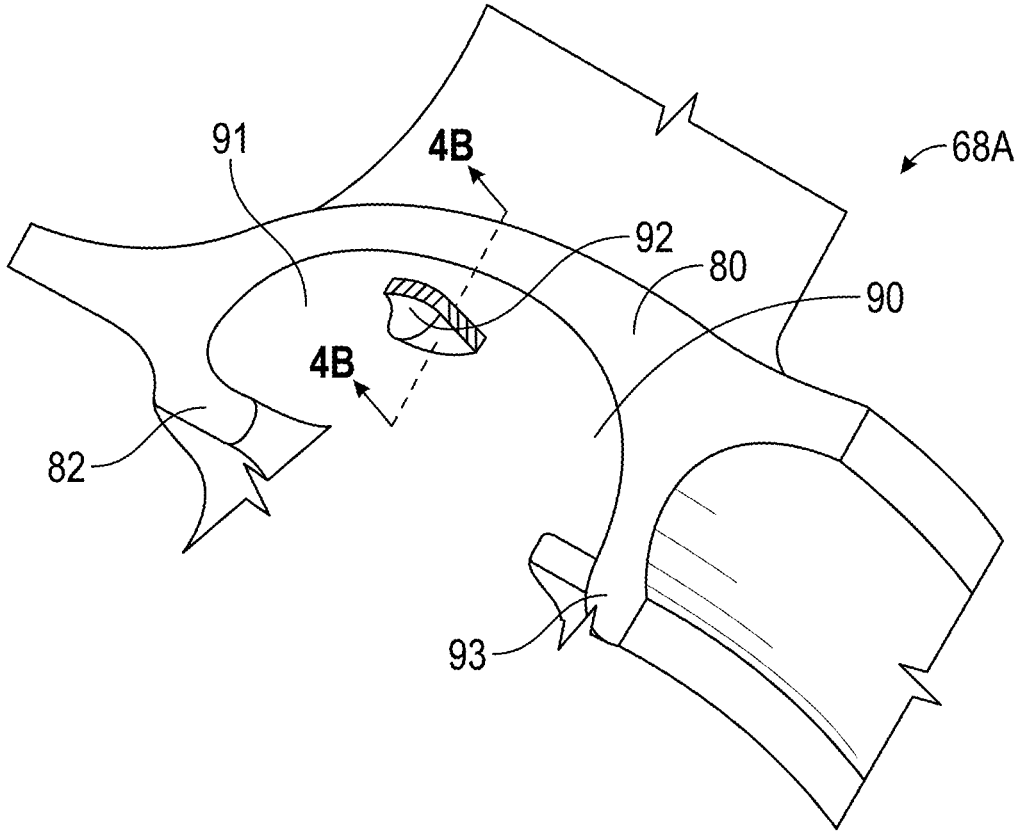
FIG. 4A illustrates a bottom perspective view of the turbine blade of FIG. 3.

FIG. 4A illustrates a lower perspective view of a turbine blade 68A to be located in the first stage 70 of the high pressure turbine 54, for example. The neck cavity 90 includes a retention nub 92 located on a lower surface 91 of the platform 80.

Figure 4B:
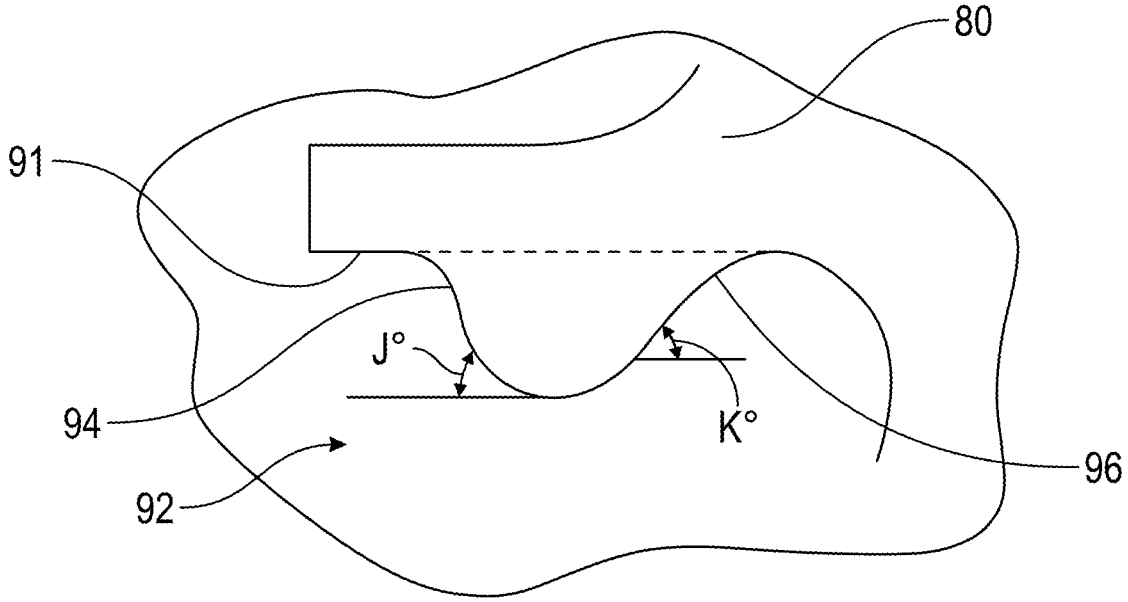
FIG. 4B illustrates a retention nub of the turbine blade the taken along section A-A of FIG. 4A.

FIG. 4B illustrates a cross-sectional view of the retention nub 92 taken along section 4B-4B of FIG. 4A. The retention nub 92 includes a first surface 94 and a second surface 96. An angle J defined between the first surface 94 and a horizontal plane is approximately 30 to 60 degrees. An angle K defined between the second surface 96 and the horizontal plane is approximately 45 to 85 degrees.

Figure 5:
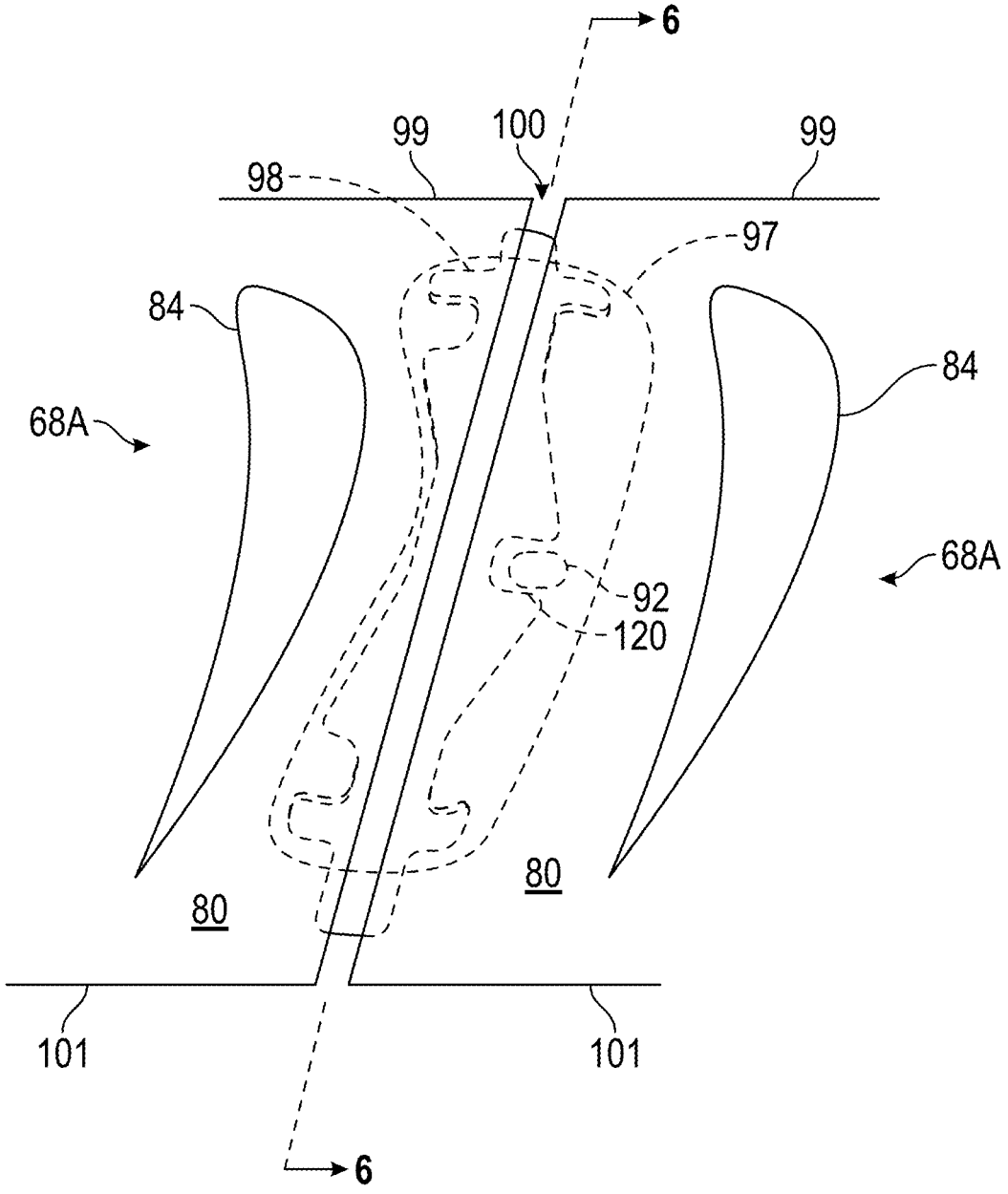
FIG. 5 is a top (partial cross-sectional view) illustrating a damper seal installed between two adjacent turbine blades.
Figure 6:
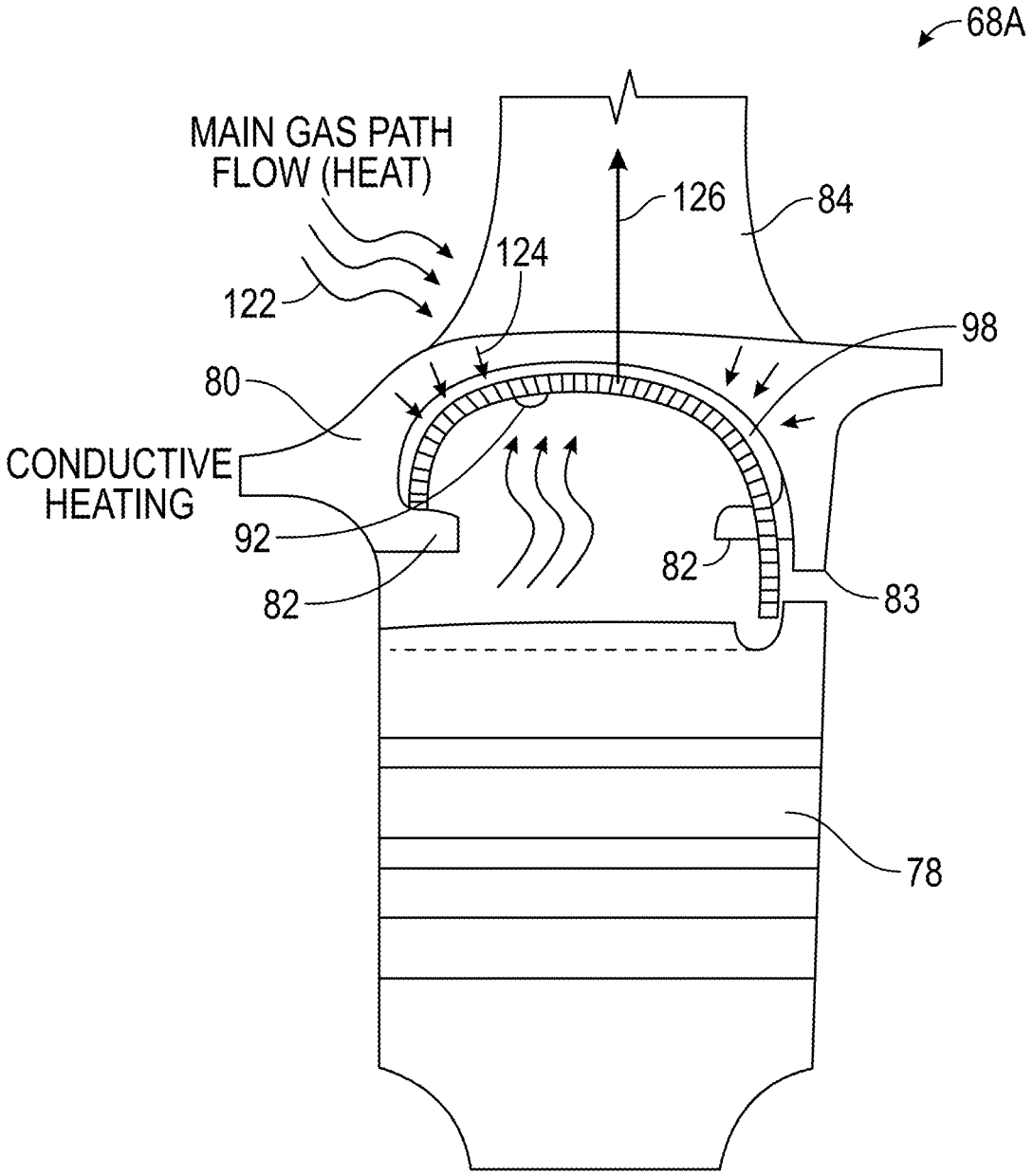
FIG. 6 is a cross-sectional side view along lines 6-6 of FIG. 5.

FIGS. 5 and 6 illustrate a damper seal 98 installed between adjacent turbine blades 68A1 and 68A2. The damper seal 98 is located in a neck cavity 90 of the turbine blades 68A1 and 68A2. The damper seal 98 is located in an under-platform pocket 97 depicted by the dashed lines in FIG. 5. The damper seal 98 is located under the platforms 80 and above the retention shelves 82 of the adjacent blades 68A1 and 68A2 and spans a space or mate face gap 100 between a leading edge 99 and a trailing edge 101 of the platforms 80 of the turbine blades 68A1 and 68A2. The retention nub 92 of the turbine blade 68A2 is received in an opening 120 of the damper seal 98.

By employing a damper seal 98 that combines the features of a damper and a seal into a single component, the number of parts and the weight is reduced. Additionally, the assembly process is simplified by requiring only one component to be installed between adjacent turbine blades 68A.

The damper seal 98 imposes a normal load on the turbine blades 68A. The resulting frictional force created by the normal load produces damping, reducing a vibratory response. The damper seal 98 prevents the cooling air F from leaking from the neck cavity 90 of the turbine blades 68A and into the hot gas flow path E along arrows G (shown in FIG. 3).

FIG. 6 illustrates a side view of the turbine blade 68A with the damper seal 98 installed in the neck cavity 90. The retention nub 92 of the turbine blade 68A is received in the opening 120 of the damper seal 98.

In the past and during assembly of the high pressure turbine rotor, the damper seal 98 sits loosely between neighboring blades. In order for the damper seal 98 to reach its design intent and reach its maximum effectiveness, a break-in period is typically required to conform to the damper seal 98 to the blade under-platform geometry. In the past, this is achieved during the initial engine start-up and operation acceptance testing, where the damper seal 98 is subject to heat from the main gas path flow (arrows 122), which is applied to the damper seal 98 through conductive paths (arrows 124) of the blade 68A. In addition, centrifugal loading in the direction of arrow 126 is also applied to the damper seal 98. As such, the damper seal 98 moves radially outward and begins to deform and take the shape of the blade under-platform geometry which increases the damping effectiveness and seals the mate-face gap 100.

In accordance with an embodiment of the present disclosure, a damper seal 98 is provided that reduces the aforementioned break-in period and allows the damper seal 98 to reach its effectiveness quicker.

Figure 7:
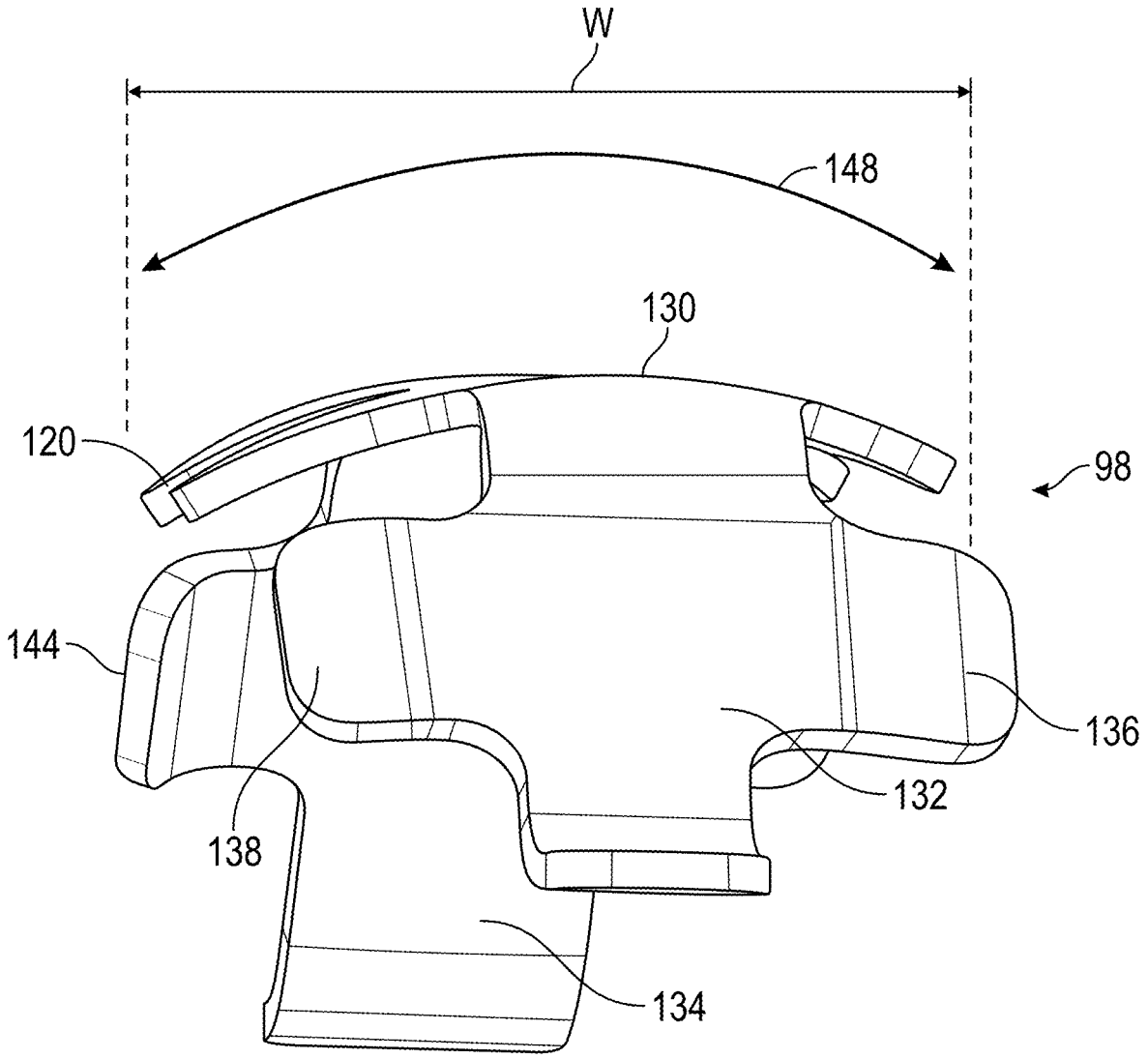
FIG. 7 is a perspective view of a damper seal in accordance with an embodiment of the present disclosure.
Figure 8:
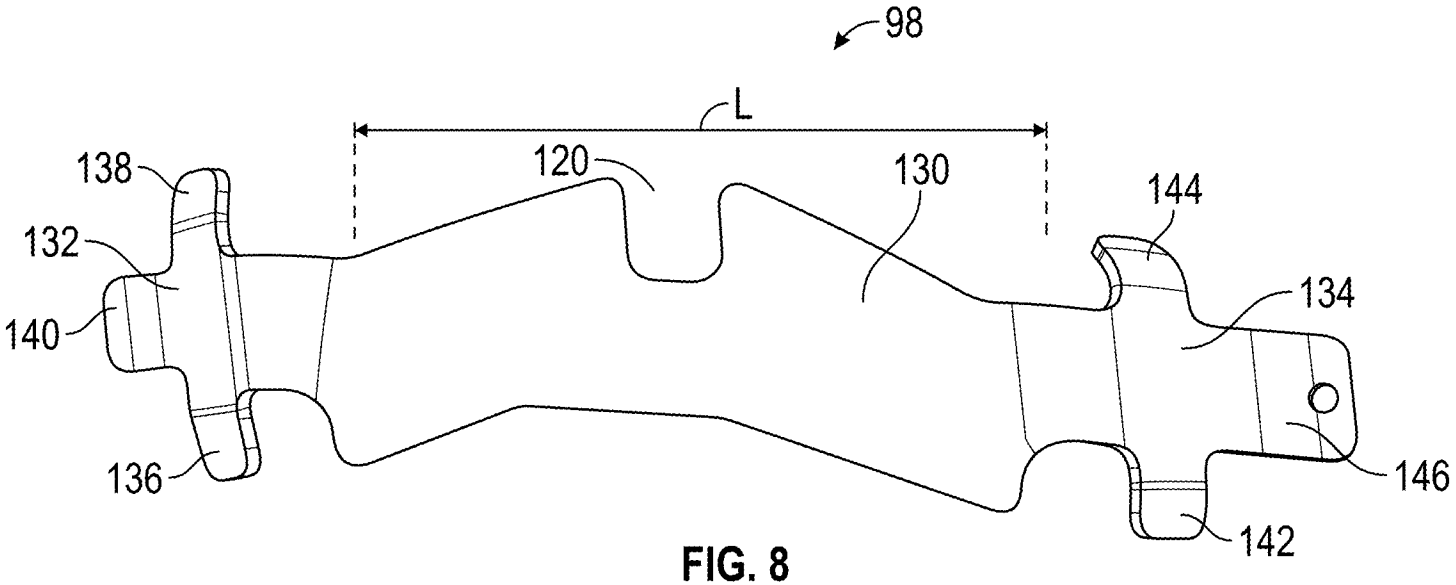
FIG. 8 is a top plan view of a damper seal in accordance with an embodiment of the present disclosure.
Figure 9:
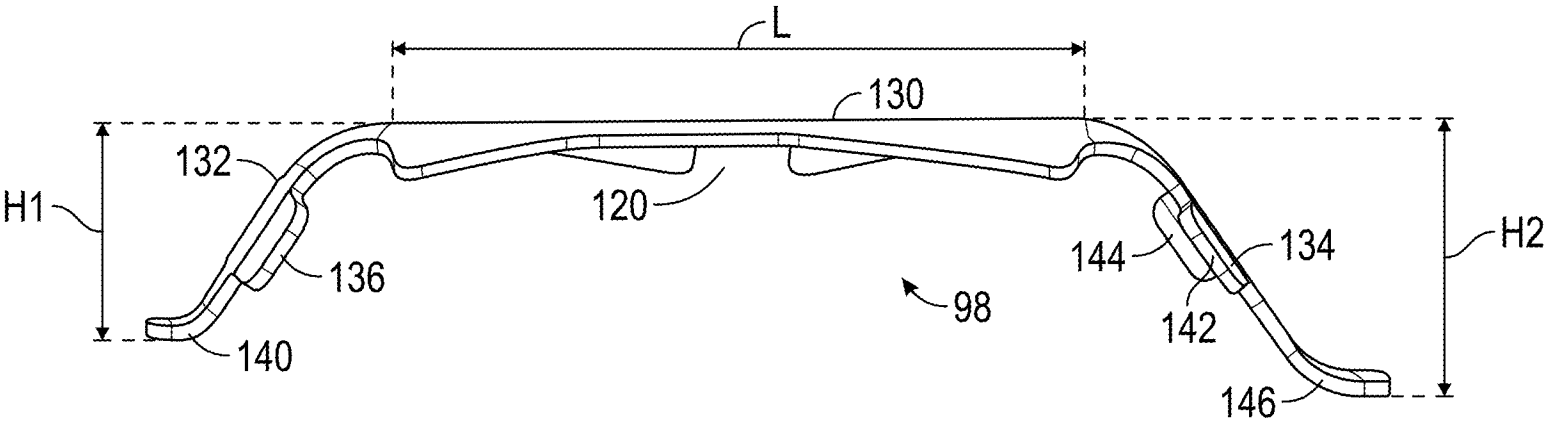
FIG. 9 is a side view of a damper seal in accordance with an embodiment of the present disclosure.

Referring now to FIGS. 7-9, a damper seal 98 in accordance with the present disclosure is illustrated. The damper seal 98 spans the space or mate face gap 100 (as shown in FIG. 5) between platforms 80 of adjacent turbine blades 68A in the first stage 70 of the high pressure turbine 54 to provide both damping and sealing and prevent the leakage of the cooling air F. The damper seal 98 imposes a normal load on the adjacent turbine blades 68A due to centrifugal force. The resulting frictional force created by the normal load produces damping to reduce a vibratory response. The damper seal 98 prevents the cooling air F in the neck cavity 90 from leaking into the hot flow gas path E along arrows G (shown in FIG. 3).

In one non-limiting embodiment, the damper seal 98 is formed from stamped sheet metal. The damper seal 98 can also be formed by direct metal laser sintering. Other manufacturing methods are possible.

The damper seal 98 has an upper portion 130. A first downwardly curved portion 132 and a second downwardly curved portion 134 that extend from opposing end regions of the upper portion 130. In one example, relative to the upper portion 130 of the damper seal 98, a height H2 of the second downwardly curved portion 134 is longer than a height H1 of the first downwardly curved portion 132.

An end region of the first downwardly curved portion 132 includes a first tab 136 and a second tab 138 that each extend in opposing directions with respect to the first downwardly curved portion 132. A third tab 140 extends from tabs 136 and 138 and also extends in the same general direction as the first downwardly curved portion 132. The third tab 140 provides sealing to the neck cavity 90 and prevents the passage of the cooling air F into the hot gas flow path E.

An end region of the second downwardly curved portion 134 includes a first tab 142 and a second tab 144. A third tab 146 extends from tabs 142 and 144 and also extends in the same general direction as the second downwardly curved portion 134. The third tab 146 provides sealing to the neck cavity 90 and prevents the passage of the cooling air F into the hot gas flow path E.

Tabs 136, 138, 142 and 144 prevent rocking of the damper seal 98 when it is between platforms 80 of adjacent turbine blades 68A.

In accordance with an embodiment of the present disclosure, the upper portion 130 of the damper seal 98 is substantially curved in the direction of arrows 148. As such, the upper portion 130 is generally curved along its width W. In one embodiment, the upper portion 130 is curved along its entire width W. As illustrated herein the width W extends in the same directions as tabs 136, 138, 142 and 144. In other words, the width W of the upper portion 130 is transverse to the length L of the upper portion or the length L of the upper portion extends along a major axis of the upper portion 130 and the width W extends along a minor axis of the upper portion 130.

In one non-limiting exemplary embodiment, the damper seal shape of the upper portion 130 or an outboard mating surface of the upper portion 130 that contacts the under-side of the blade platforms will have a constant radius profile running from leading to trailing ends of the underside of the blade/platform until transitioning to the first downwardly curved portion 132 and the second downwardly curved portion 134 which include the tabs 136, 138, 140, 142, 144, 146.

Figure 10:
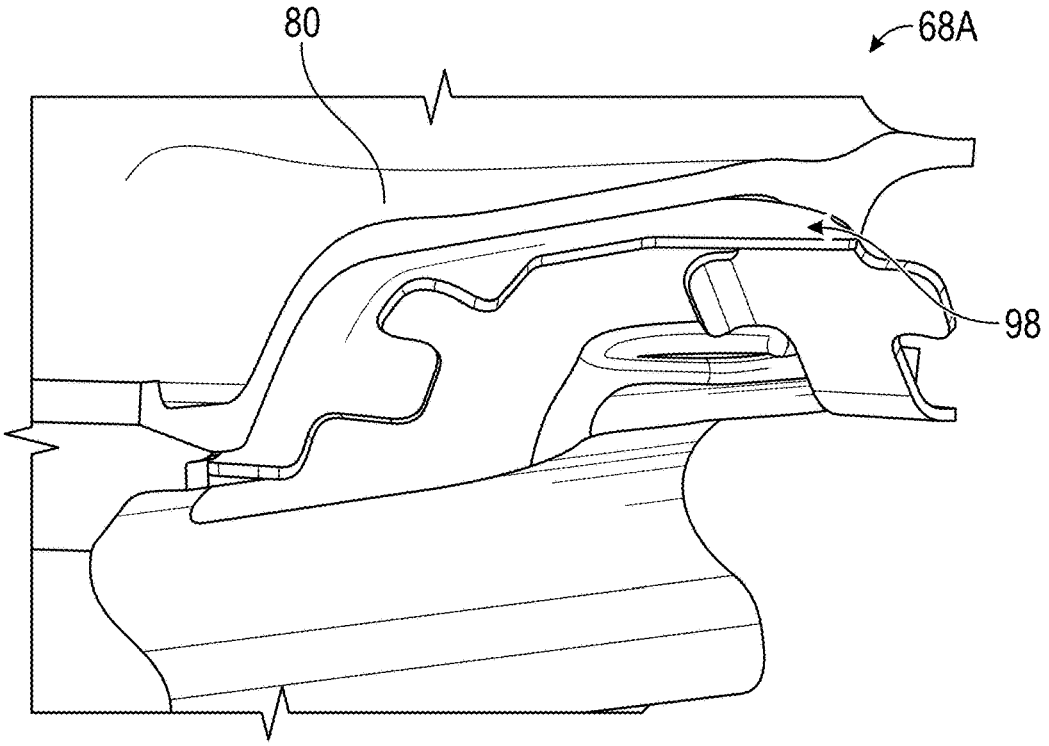
FIG. 10 is a partial perspective view illustrating the damper seal secured to a turbine blade.

FIG. 10 is a partial perspective view illustrating the damper seal 98 secured to a turbine blade 68A.

Referring now to at least FIGS. 11-16 differences between a damper seal 150 without a curved upper portion 130 and a damper seal 98 with a curved upper portion 130 in accordance with the present disclosure is illustrated.

Figure 11:
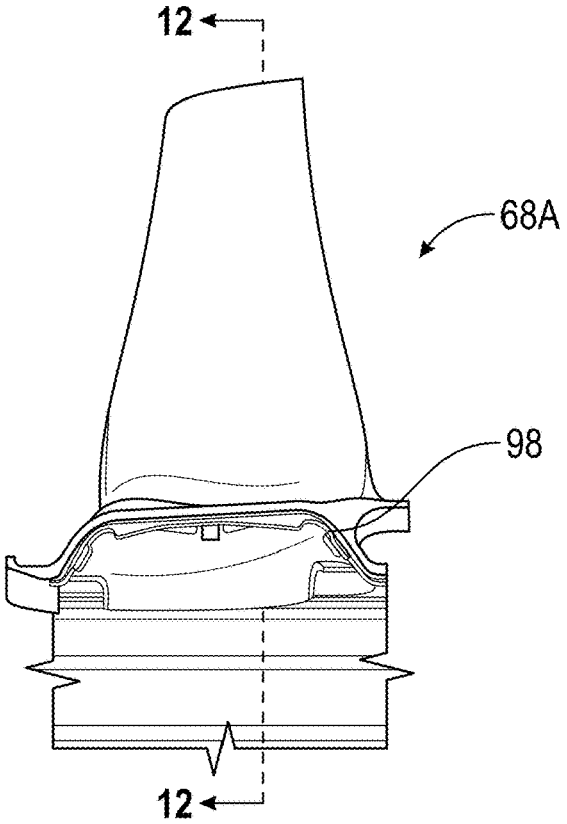
FIG. 11 is a side view illustrating the damper seal secured to a turbine blade.
Figure 13:
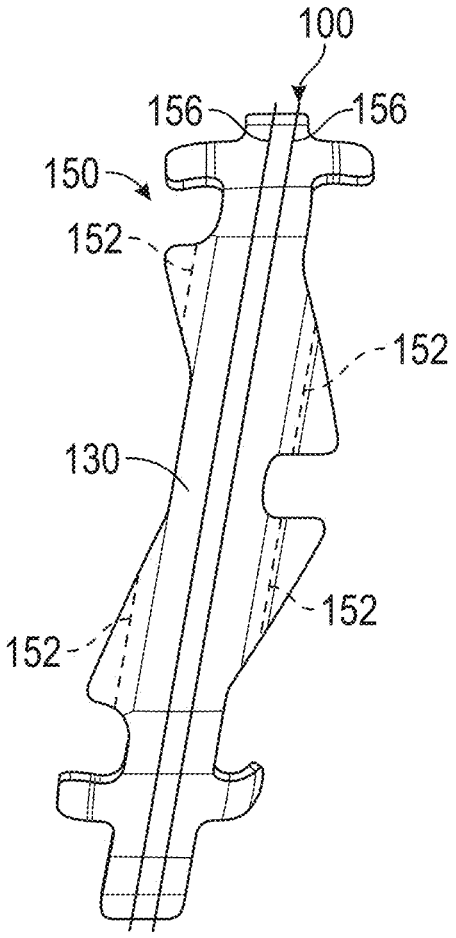
FIG. 13 is top plan view of a damper seal without a curved upper portion and illustrating initial line contacts of the damper seal with the platforms of adjacent turbine blades.

In FIG. 11 is a side view of a turbine blade 68A with a damper seal is illustrated. In FIG. 13 a top plan view of the damper seal 150 without a curved upper portion 130 is illustrated. FIG. 13 illustrates initial lines of contact 152 of the damper seal 150 with an underside 154 of platforms 80 of adjacent turbine blades 68A prior to the aforementioned break-in period.

Figure 14:
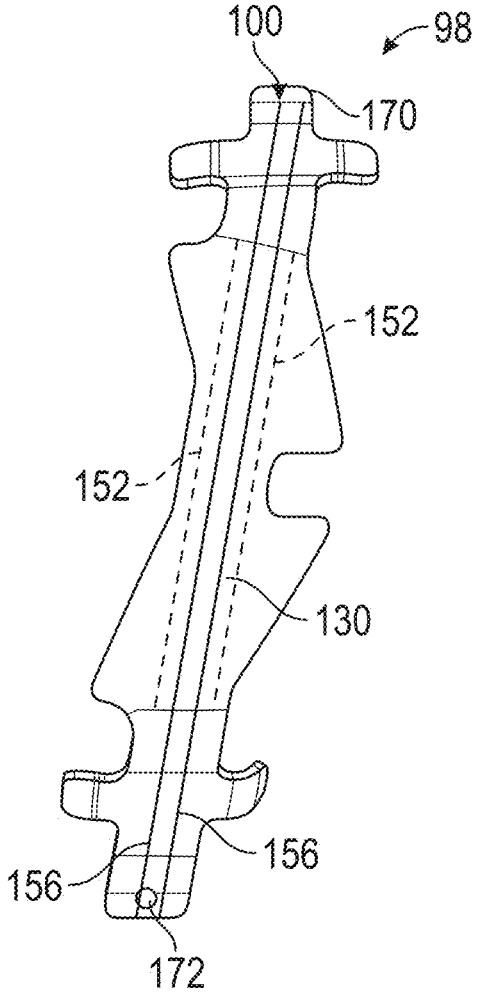
FIG. 14 is top plan view of a damper seal in accordance with an embodiment of the present disclosure and with a curved upper portion, illustrating initial line contacts of the damper seal with the platforms of adjacent turbine blades.

In contrast and in FIG. 14, a top plan view of the damper seal 98 without a curved upper portion 130 is illustrated. FIG. 14 also illustrates initial lines of contact 152 of the damper seal 150 with an underside 154 of platforms 80 of adjacent turbine blades 68A prior to the aforementioned break-in period.

As clearly illustrated, the initial lines of contact 152 of the damper seal 98 are much closer to each other than the initial lines of contact 152 of the damper seal 150. Also illustrated in FIGS. 13 and 14 is the location of the mate face gap 100 on the upper portion 130 of damper seals 98 and 150 when they are initially located between a pair of turbine blades 68A prior to the aforementioned break-in period. This location is illustrated by pair of lines 156. Also and as illustrated in FIGS. 13 and 14, the initial lines of contact 152 of the damper seal 98 are much closer to the mate face gap 100.

Figure 12:
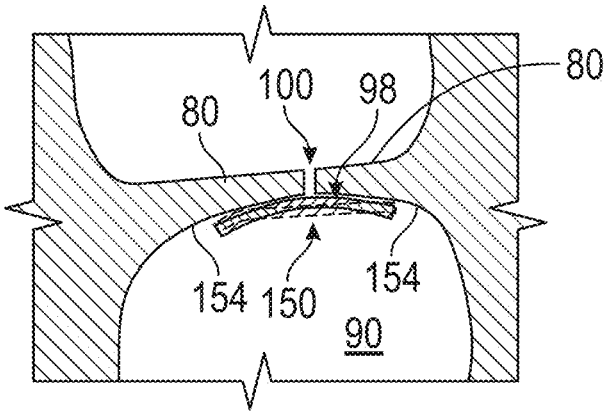
FIG. 12 is a view along lines 12-12 of FIG. 11 when a damper seal is secured to a pair of turbine blades.

Referring now to FIG. 12, a view along lines 12-12 of FIG. 11 is illustrated when the damper seal is located underneath the platforms 80 of adjacent turbine blades 68A prior to the aforementioned break-in period. In FIG. 12, the locations of both damper seal 98 with a curved upper portion 130 and damper seal 150 without a curved upper portion 130 are superimposed on each other. As clearly illustrated, the damper seal 98 with the curved upper portion 130 pre-conformed to the contours of the underside 154 of the platforms 80 of the turbine blades 68A will have a greater surface area in direct contact with the underside 154.

Figure 15:
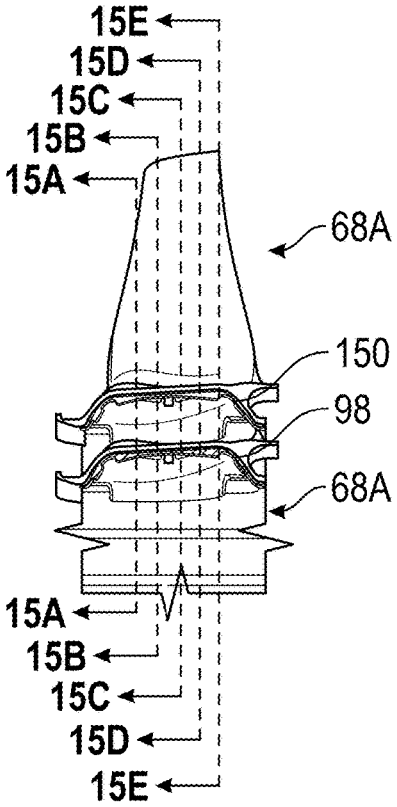
FIG. 15 is a superimposed side view illustrating two turbine blades one with a damper seal not pre-formed in accordance with an embodiment of the present disclosure (no curved upper portion) and one with a damper seal preformed in accordance with an embodiment of the present disclosure (curved upper portion)

FIG. 15 is a side view illustrating two turbine blades superimposed on each other, one with a damper seal 150 (not pre-formed in accordance with an embodiment of the present disclosure) and one with a damper seal 98 (preformed in accordance with an embodiment of the present disclosure).

Figure 15A:
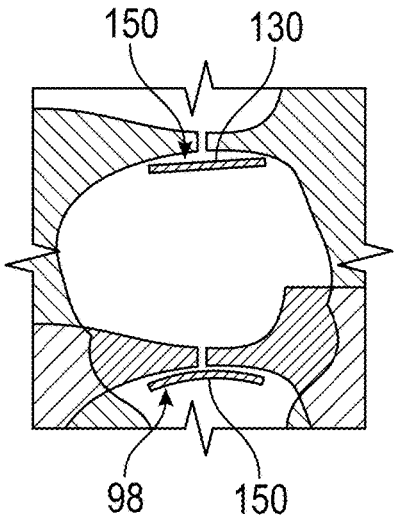
FIG. 15A is a view along lines 15A-15A of FIG. 15 when the damper seals are secured to a pair of turbine blades.
Figure 15B:
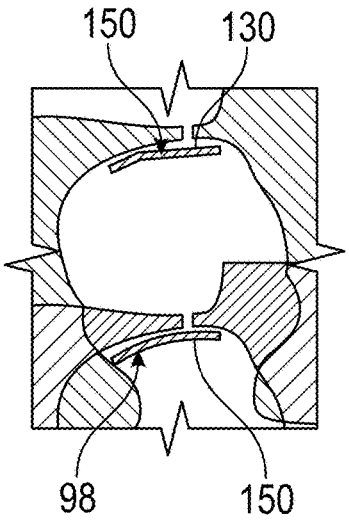
FIG. 15B is a view along lines 15B-15B of FIG. 15 when the damper seals are secured to a pair of turbine blades.
Figure 15C:
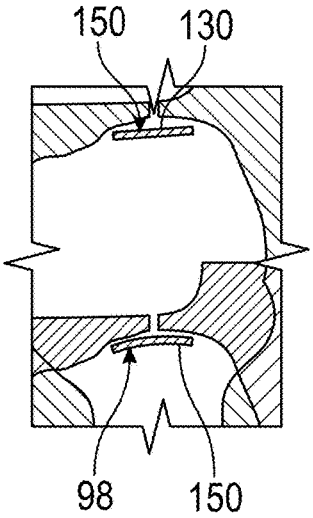
FIG. 15C is a view along lines 15C-15C of FIG. 15 when the damper seals are secured to a pair of turbine blades.
Figure 15D:
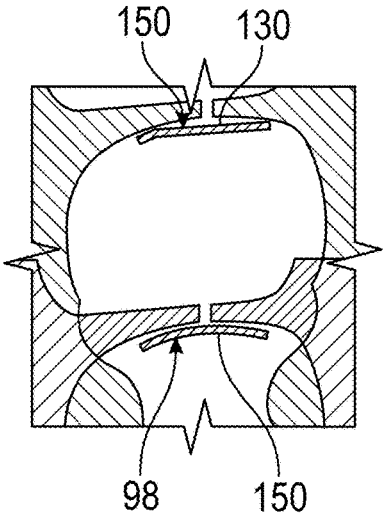
FIG. 15D is a view along lines 15D-15D of FIG. 15 when the damper seals are secured to a pair of turbine blades.
Figure 15E:
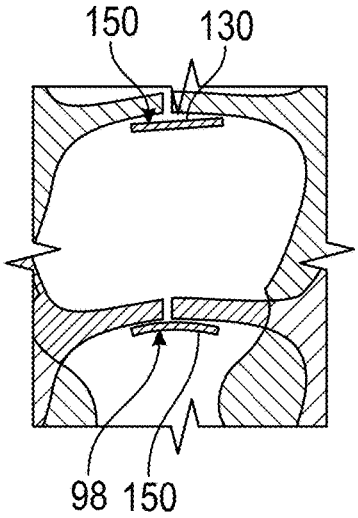
FIG. 15E is a view along lines 15E-15E of FIG. 15 when the damper seals are secured to a pair of turbine blades.

FIG. 15A is a view along lines 15A-15A of FIG. 15 when the damper seals 98, 150 are secured to a pair of turbine blades 68A. FIG. 15B is a view along lines 15B-15B of FIG. 15 when the damper seals 98, 150 are secured to a pair of turbine blades 68A. FIG. 15C is a view along lines 15C-15C of FIG. 15 when the damper seals 98, 150 are secured to a pair of turbine blades 68A. FIG. 15D is a view along lines 15D-15D of FIG. 15 when the damper seals 98, 150 are secured to a pair of turbine blades 68A. FIG. 15E is a view along lines 15E-15E of FIG. 15 when the damper seals 98, 150 are secured to a pair of turbine blades 68A. FIGS. 15A-15E clearly illustrate that a greater surface area of upper portion 130 of damper seal 98 contacts the underside 154 than the upper portion 130 of damper seal 150.

Figure 16:
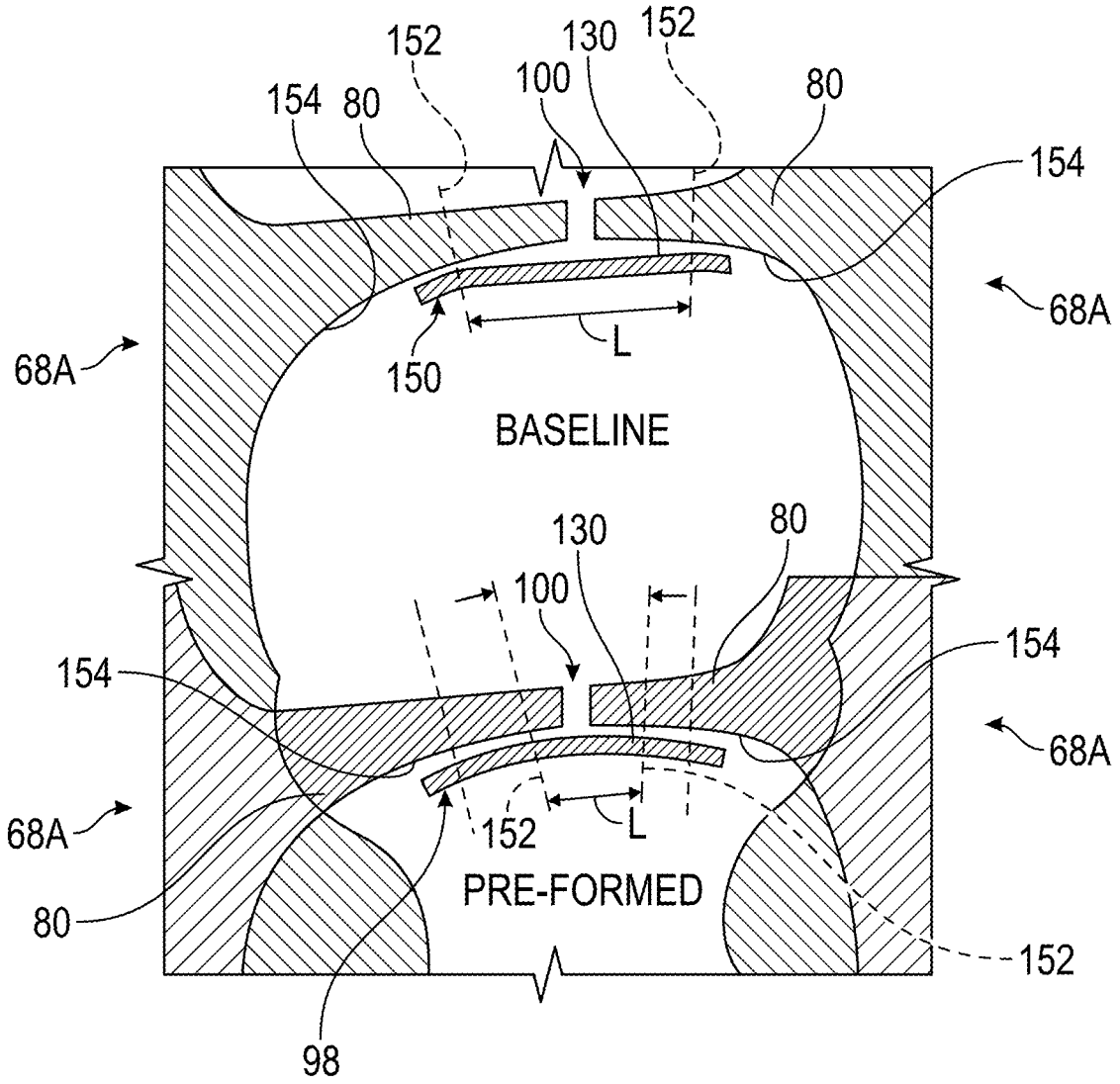
FIG. 16 is an enlarged view of FIG. 15D.

FIG. 16 is an enlarged view of FIG. 15D. As clearly illustrated, the initial lines of contact 152 for damper seal 98 in comparison to damper seal 150 are moved towards the damper seal center or mate face gap center 100. This results in an increased stiffness of the damper seal. Reduction in the distance L between the initial points of contact 152 of the damper seal 150 and the initial points of contact 152 of the damper seal 98 helps with this increased stiffness of the damper seal.

By providing a damper seal 98 with a curved upper portion or curved central portion 130 and as discussed above, this reduces break-in period requirements, which achieves early damper seal effectiveness, and thus reduces overall engine testing time. As such and in order to reduce an overall initial engine testing time, a pre-formed damper seal with a curved upper portion is needed.

In contrast to the flat outboard surface or upper portion 130 provided in damper seal 150, the radial profile of the damper seal 98 shifts the initial contact zones on both blades towards the center of the platform gap or mate face gap. As such, this radial profile or curved upper portion allows the damper 98 to conform to geometry quickly as it can rotate tangentially (relative to the rotor axis) to accommodate the total tolerance stack of the assembled hardware (e.g., adjacent blades 68A).

Ensuring better initial contact between the damper seal and the neighboring blades 68A as well as the ability to quickly center with the tolerance stack range of the assembly achieves a reduction in engine break-in period requirements and thus, reduces overall engine testing time.

Referring now to at least FIGS. 8, 9 and 14, the damper seal 98 may comprise a mistake proofing tab 170 extending from the third tab 140 of the first downwardly curved portion 132 and a mistake proofing opening or hole 172 located in the third tab 146 of the second downwardly curved portion 134. Mistake proofing tab 170 and mistake proofing opening or hole 172 will help ensure that the damper seal if properly located in between adjacent turbine blades 68A as tab 170 and/or opening 172 will prevent proper insertion of the damper seal between adjacent blades 68A by for example having tab 170 engage a feature of the turbine blades 68A and/or a protrusion being received within opening or hole 172. Although a mistake proofing tab 170 and a mistake proofing opening or hole 172 are illustrated in at least FIGS. 8, 9 and 14, it is contemplated that the damper seal 98 can be made without mistake proofing tab 170 and mistake proofing opening or hole 172. In other words, at least one embodiment of the present application does not have or require the mistake proofing tab 170 and/or the mistake proofing opening or hole 172.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A damper seal for a turbine blade of a gas turbine engine, the damper seal comprising: an upper portion; a first downwardly curved portion; and a second downwardly curved portion, the first downwardly curved portion and the second downwardly curved portion extend from opposing end regions of the upper portion, the upper portion having a length extending between the opposing end regions of the upper portion and a width transverse to the length, wherein the upper portion is pre-formed in a curve along the entire width as it extends along the length.

2. The damper seal as in claim 1, wherein the width of the upper portion has a constant radius profile running along the entire width as it extends along the length.

3. The damper seal as in claim 1, wherein the first downwardly curved portion includes a first tab and a second tab each extending in opposing directions with respect to the first downwardly curved portion, and a third tab that extends from the first tab and the second tab of the first downwardly curved portion in the same general direction as the first downwardly curved portion; and the second downwardly curved portion includes a first tab and a second tab each extending in opposing directions with respect to the second downwardly curved portion, and a third tab that extends from the first tab and the second tab of the second downwardly curved portion in the same general direction as the second downwardly curved portion.

4. The damper seal as in claim 1, wherein a height of the second downwardly curved portion relative to the upper portion is longer than a height of the first downwardly curved portion relative to the upper portion.

5. The damper seal as in claim 1, wherein the damper seal is formed from stamped sheet metal.

6. The damper seal as in claim 3, further comprising a mistake proofing tab extending from the third tab of the first downwardly curved portion and a mistake proofing opening located in the third tab of the second downwardly curved portion.

7. The damper seal as in claim 3, wherein the width of the upper portion has a constant radius profile running along the entire width as it extends along the length.

8. The damper seal as in claim 7, wherein a height of the second downwardly curved portion relative to the upper portion is longer than a height of the first downwardly curved portion relative to the upper portion.

9. The damper seal as in claim 8, wherein the damper seal is formed from stamped sheet metal.

10. A turbine disk of a gas turbine engine having a plurality of turbine blades each of the plurality of turbine blades being secured to the turbine disk, at least one of the plurality of turbine blades comprising:

a root;

a platform located between the root and an airfoil of the at least one of the plurality of turbine blades, wherein platforms of adjacent turbine blades of the plurality of turbine blades of the disk define a cavity; and a damper seal received in the cavity the damper seal comprising:

an upper portion;

a first downwardly curved portion; and a second downwardly curved portion, the first downwardly curved portion and the second downwardly curved portion extend from opposing end regions of the upper portion, the upper portion having a length extending between the opposing end regions of the upper portion and a width transverse to the length, wherein the upper portion is pre-formed in a curve along the entire width as it extends along the length, the upper portion being positioned to cover a mate face gap between platforms of adjacent turbine blades of the disk.

11. The turbine disk as in claim 10, wherein the width of the upper portion has a constant radius profile running along the entire width as it extends along the length.

12. The turbine disk as in claim 10, wherein the first downwardly curved portion includes a first tab and a second tab each extending in opposing directions with respect to the first downwardly curved portion, and a third tab that extends from the first tab and the second tab of the first downwardly curved portion in the same general direction as the first downwardly curved portion; and the second downwardly curved portion includes a first tab and a second tab each extending in opposing directions with respect to the second downwardly curved portion, and a third tab that extends from the first tab and the second tab of the second downwardly curved portion in the same general direction as the second downwardly curved portion.

13. The turbine disk as in claim 10, wherein a height of the second downwardly curved portion relative to the upper portion is longer than a height of the first downwardly curved portion relative to the upper portion.

14. The turbine disk as in claim 10, wherein the damper seal is formed from stamped sheet metal.

15. The turbine disk as in claim 12, wherein the damper seal further comprises a mistake proofing tab extending from the third tab of the first downwardly curved portion and a mistake proofing opening located in the third tab of the second downwardly curved portion.

16. The turbine disk as in claim 12, wherein the width of the upper portion has a constant radius profile running along the entire width as it extends along the length.

17. The turbine disk as in claim 16, wherein a height of the second downwardly curved portion relative to the upper portion is longer than a height of the first downwardly curved portion relative to the upper portion.

18. The turbine disk as in claim 10, wherein the turbine disk is a first stage of a high pressure turbine.

19. A method of damping vibrations between adjoining blades of a gas turbine engine, comprising: locating a damper seal adjacent to a mate face gap defined by adjacent platforms of blades secured to a disk of the gas turbine engine, the damper seal comprising an upper portion; a first downwardly curved portion; and a second downwardly curved portion, the first downwardly curved portion and the second downwardly curved portion extend from opposing end regions of the upper portion, the upper portion having a length extending between the opposing end regions of the upper portion and a width transverse to the length, wherein the upper portion is pre-formed in a curve along the entire width as it extends along the length.

20. The method as in claim 19, wherein the width of the upper portion has a constant radius profile running along the entire width as it extends along the length.

* * * * *